US006606059B1

(12) United States Patent
Barabash

(10) Patent No.: US 6,606,059 B1
(45) Date of Patent: Aug. 12, 2003

(54) ANTENNA FOR NOMADIC WIRELESS MODEMS

(75) Inventor: Darrell W. Barabash, Grapevine, TX (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/649,311

(22) Filed: Aug. 28, 2000

(51) Int. Cl.[7] ..... H01Q 3/02
(52) U.S. Cl. ..... 343/700 MS; 343/702
(58) Field of Search ..... 343/700 MS, 709, 343/895, 891, 893, 725, 729, 824; 333/17.2; 342/374, 434, 435, 403

(56) References Cited

U.S. PATENT DOCUMENTS 4,349,824 A * 9/1982 Harris ..... 343/700 MS
4,890,001 A * 12/1989 Eickelmann ..... 307/38
5,300,900 A * 4/1994 Bellantoni ..... 333/17.2
5,479,176 A * 12/1995 Zavrel, Jr. ..... 342/374
5,617,102 A * 4/1997 Prater ..... 342/374
5,654,722 A * 8/1997 Lundback et al. ..... 343/725
6,094,166 A * 7/2000 Martek et al. ..... 342/374
6,222,502 B1 * 4/2001 Falbo et al. ..... 343/879
6,337,668 B1 * 1/2002 Ito et al. ..... 343/833

* cited by examiner

*Primary Examiner*—Don Wong
*Assistant Examiner*—James Clinger
(74) *Attorney, Agent, or Firm*—Blakley, Sokoloff, Taylor & Zafman LLP

(57) ABSTRACT

An antenna utilizes multiple radiating elements placed at regular interval around a geometric structure. Each of the individual radiating elements are selectably activated in order to narrow the range of transmission and reception for the antenna. Larger antenna gain is achieved by narrowing the radiation pattern and each individual radiating element has significantly more gain than an omni-directional radiator while also reducing the power output requirements of the transmitter.

39 Claims, 15 Drawing Sheets

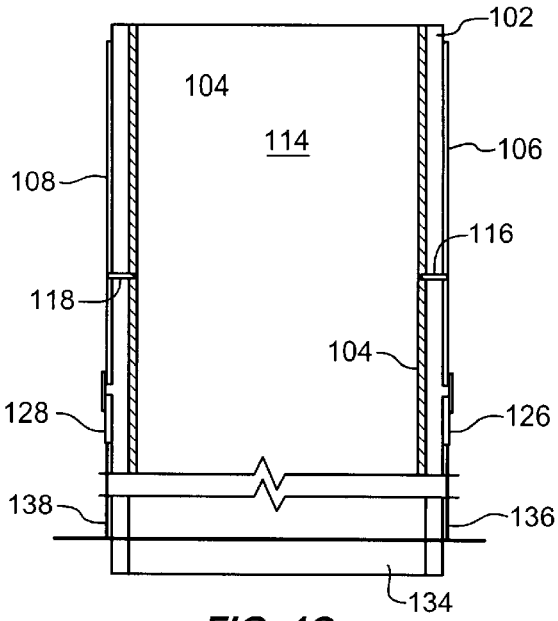
FIG. 4C
FIG. 4D
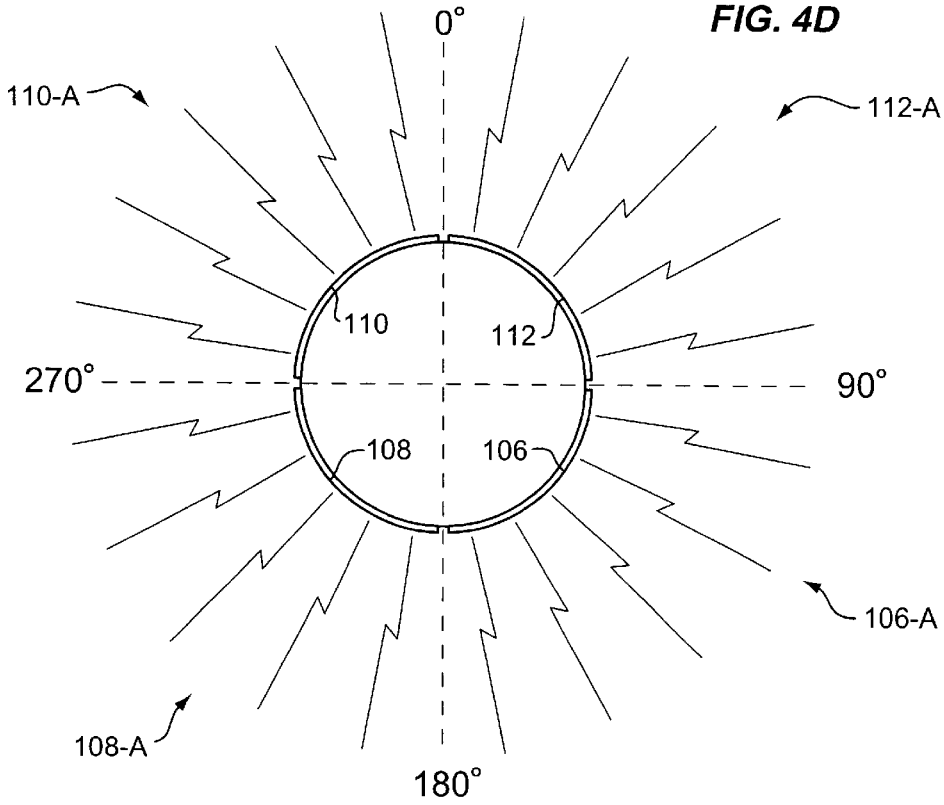

Total Radiated Power (dBm): RadPower = $2.06*10^{-4}$

Antenna Efficiency: $\eta$ = 85.277 % (expect 74%)

Antenna Directivity (dBi): Directivity = 6.241 (expect 5.6 dBi)

ANTENNA FOR NOMADIC WIRELESS MODEMS

FIELD OF THE INVENTION

The present invention pertains to antenna systems, including more particularly to antennas with directionally selectable transmission capabilities.

BACKGROUND OF THE INVENTION

In wireless voice and data applications, both wireless local loop (WLL) and mobile applications, system capacity remains an important design issue since the power available to a wireless device is often limited. Interference with other devices also limits the system capacity. When operating from a battery supply, such as with a wireless phone, pager, or modem, this problem is exacerbated.

In mobile wireless applications, such as cell phones, pagers, and wireless modems, the spatial orientation of the device antenna is not static (i.e. the user is often moving, or the device itself is moving). Since the instantaneous orientation of the antenna is essentially unknown to a designer of these devices, known wireless systems have addressed this design problem by providing an omni-directional antenna. Omni-directional antennas produce a substantially constant radiation pattern in essentially all directions in at least one plane. While this effectively ensures that the antenna signal reaches an intended base station regardless of the orientation of the antenna or wireless device, it does so at the cost of wasted power and the potential for interference with other users and electronic systems. Whip antennas (long, thin extending antennas) that are often incorporated into cellular phones and other wireless voice and data systems, often utilize this omni-directional transmission technique. This will be the case regardless of where the base station is positioned in relation to the wireless device.

Several problems still remain with the use of these known omni-directional antennas and the use of an omni-directional transmission scheme. First, since an omni-directional antenna radiates in all directions at all times, the transmission may interfere with the other non-target base stations that are within the transmission range of the antenna. As a result, these systems may impact the overall system capacity. Second, since for a given coverage distance, omni-directional antennas have a lower gain than a similarly powered antenna that has a more focused directivity, a larger transmitter power is typically required to effectively operate them. Increasing the transmitter power usually results in increased heat, increased product cost, and increased power consumption, all of which are undesirable.

Known Radio Frequency switching devices that can selectively couple a signal with a particular output, often employ a capacitive junction that functions as a switch to turn the device on or off. In systems that demand complete isolation from the remainder of the circuit, the use of these devices still may present problems due to the remaining capacitance in the off-state. This may limit their ability to provide complete isolation. Since it is still desirable to use these devices due to their low cost and wide availability, a system that cancels the effect of this capacitance is needed.

SUMMARY OF THE INVENTION

The present invention comprises an antenna with selectably activated radiating elements. In a first embodiment, an antenna comprises a dielectric body and a radiating element formed on the dielectric body. The antenna also comprises a transmission line and a switching device, the switching device has an input and an output, the input is connected to the transmission line and the output is connected to the radiating element.

In another embodiment, an antenna having an exterior surface comprises a plurality of radiating elements formed on the exterior surface of the antenna and switching circuitry connected to said plurality of radiating elements and said transmission line.

In another embodiment, an antenna comprises a dielectric body having an interior and an exterior surface. A plurality of radiating elements is formed on the exterior surface of the antenna body. The antenna also comprises a transmission line and a switching device operative to selectively connect the transmission line with at least one of the radiating elements.

Other embodiments will become apparent hereinafter.

BRIEF DESCRIPTION OF THE DRAWINGS

FIG. 4C shows a top cross sectional view of the antenna of FIG. 4A;

FIG. 4D shows a top view of the antenna of FIG. 4A and the representative radiation patterns of each of the radiating elements;

DETAILED DESCRIPTION OF THE PREFERRED EMBODIMENTS

Figure 1:
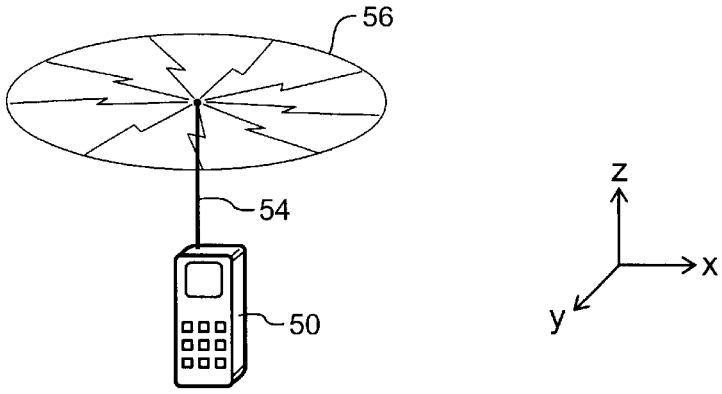
FIG. 1 shows a known wireless device that utilizes an omni-directional antenna, and the associated antenna radiation pattern.

FIG. 1 shows a wireless device 50, such as a cell phone, wireless modem, radio module, or pager. Wireless devices, such as the wireless device 50, most often rely on an antenna 54 in order to maintain communication with a base station (not shown). Base stations typically serve as a link between the wireless device and a larger communication network, such as a publicly switched telephone network (PSTN), or a company network. The base stations allow the wireless devices to access larger data and voice distribution networks throughout the world. Most wireless devices, such as the wireless device 50 shown in FIG. 1, utilize a whip or telescoping type of antenna 54 in order to broadcast and receive voice and data signals between the wireless device 50 and a base station. Commercial products manufactured by companies such as Nokia, Ericsson, and Qualcom, utilize whip antennas with a vertical orientation and the antennas used in these products produce an omni-directional radiation pattern in the horizontal plane. Radiation patterns produced by such antennas generally extend outward in all directions from the antenna.

In FIG. 1, a radiation pattern 56 is shown emanating from the omni-directional antenna 54 and represents the manner in which omni-directional antennas operate. For ease of illustration, only a single component plane of the radiation pattern 56 is shown, i.e. only the x-y plane component of the radiation pattern is shown. The z-x plane component of the radiation pattern would resemble the shape of a torus. Common to most omni-directional antennas is that the radiation pattern of the antenna signal is directed away from the antenna in a 360° azimuth at all times the antenna is transmitting.

Figure 2:
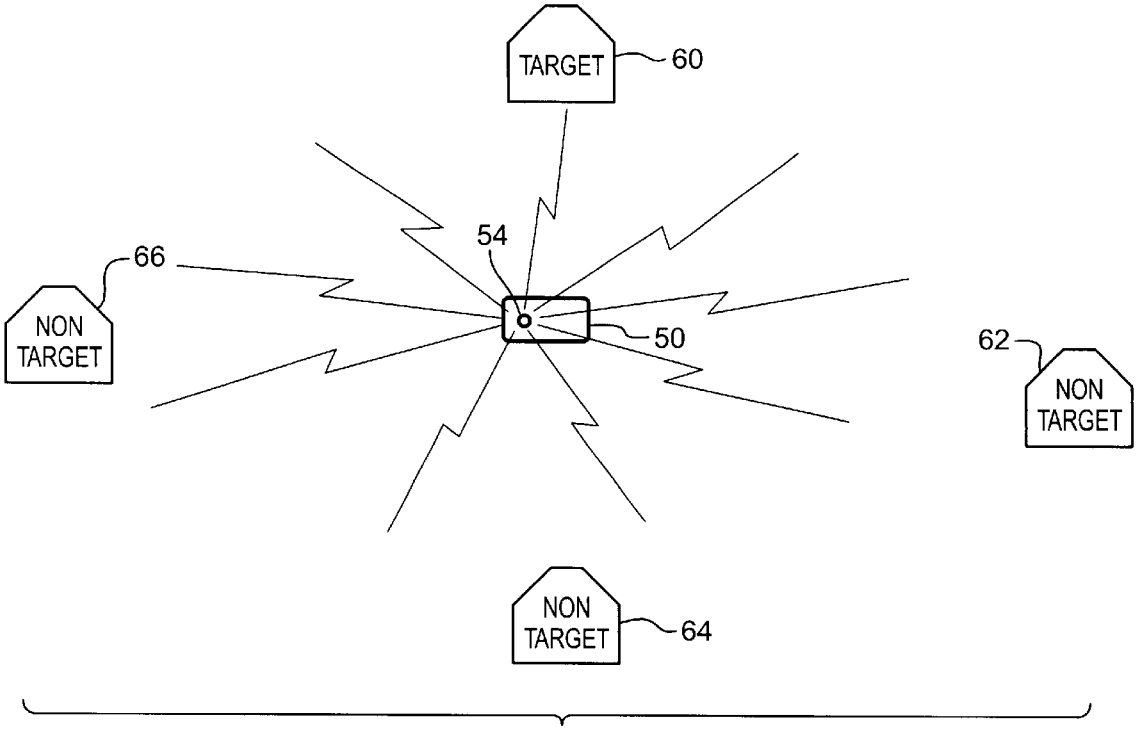
FIG. 2 is a top view of the wireless device of FIG. 1 showing it in relation to a network of base stations.

FIG. 2 illustrates how the wireless device 50 utilizing an omni-directional antenna 54 operates in relation to a network of base stations. When the wireless device 50 is activated, either by a user, or by an electronic system, it transmits or receives a signal through its antenna 54 until a base station 60 is acquired. Several base stations may be in the vicinity of the wireless device 50, and the one that is ultimately acquired is referred to as the target base station. In FIG. 2, the target base station is represented by reference number 60. Most often, the target base station 60 is the base station that is closest to the wireless device 50. Most commonly, this is the base station that provides the strongest and most consistent signal between the base station 60 and the wireless device 50. Upon activation, the wireless device 50 transmits its signal in all directions from the antenna 54. Other visible base stations 62, 64, and 66, that may be within the transmitter range of the wireless device 50 may also see the signal generated by the wireless device 50 but do not establish a connection, typically due to the inferiority of the signal. Even after the target base station 60 is acquired by the wireless device, the antenna 54 continues to broadcast its signal in all directions. This is consistent with the operation of an omni-directional antenna. Since most of the signal pattern transmitted by the antenna 54 is not directed toward the acquired target base station 60, a large portion of the power that is used to transmit the signal is wasted. Depending on the distance between the target base station and the antenna, as much as 90% of the transmitter power may be wasted.

Since a large portion of the transmission strength is wasted when utilizing an omni-directional antenna, a larger transmitter power is required in order to maintain a strong and consistent signal connection between the target base station 60 and the wireless device 50. Furthermore, since the signal generated within the antenna radiation pattern 56 is still being broadcast toward the other non-target but visible base stations after the target base station 60 has been acquired, the other "non-target" base stations may experience a degradation in performance due to the interference generated by transmissions that are not intended for that particular base station. Likewise, the target base station 60 that a particular antenna has acquired, may itself experience performance degradation from other wireless devices operating in its vicinity.

Figure 3A:
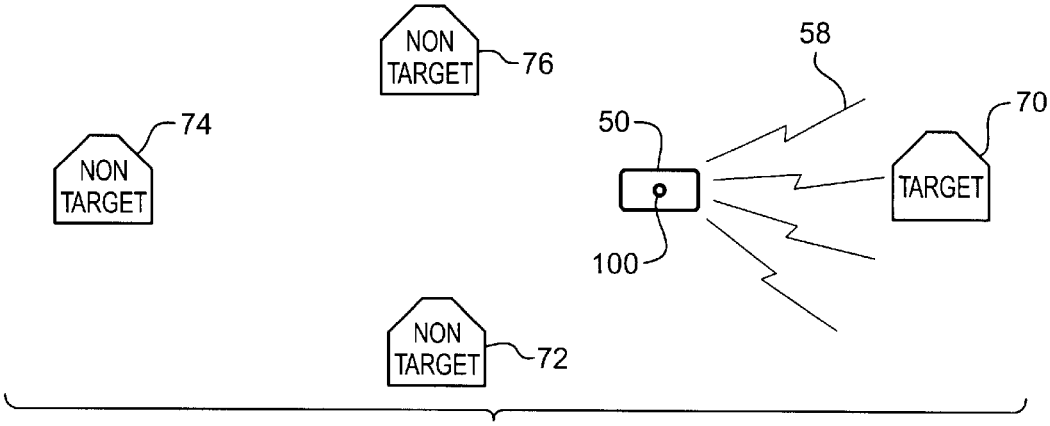
FIGS. 3A–3C are diagrams of a wireless device utilizing an antenna in accordance with the present invention in relation to a network of base stations.
Figure 3B:
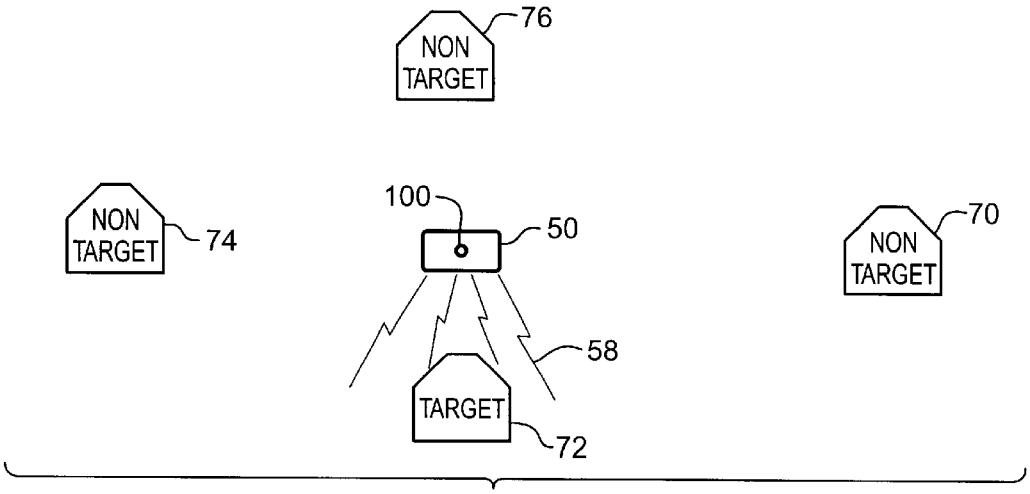
Figure 3C:
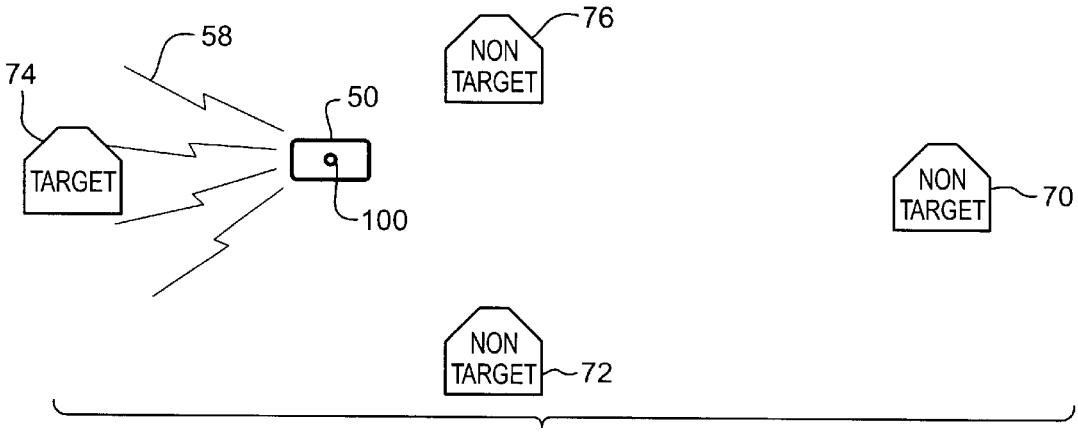

FIGS. 3A–3C illustrate how an antenna in accordance with the present invention can improve the power efficiency of a wireless device 50, while simultaneously reducing the amount of signal interference seen by non-target base stations. Referring to FIG. 3A, the wireless device 50, includes an antenna 100 in accordance with the present invention. When activated by a user, the wireless device 50 searches for and acquires a target base station. In FIG. 3A, the target base station is represented by reference number 70. Typically, the target base station is the one that maintains the strongest and most consistent signal with the wireless device 50. Most often the strongest signal is obtained from the base station that is in closest proximity to the wireless device 50, however, topographic variations, and other sources of interference may dictate that a more distant base station be acquired as the target base station.

Once the target base station 70 has been acquired by the wireless device 50, the transmitted radiation pattern 58 of the antenna 100 is restricted to the specific radiating element that was directed toward the target base station 70. Briefly, an antenna in accordance with the present invention utilizes a series of radiating elements. Only one of the radiating elements are utilized once a base station has been acquired, in order to focus the radiation pattern of the antenna toward the target base station 70 and eliminate the excess power needed to transmit the same signal in all directions. In FIG. 3A, the non-target base stations that are proximate to the wireless device 50 are indicated by reference numbers 72, 74, and 76. Alternately, more than one radiating element may be activated in order to find the best combination of signal strength and power efficiency.

Since a primary feature of wireless devices are their mobility, a user will most likely be continuously moving and venturing in and out of a particular base station's range. When the signal strength between a particular target base station and the wireless device 50 changes, periodic handoffs to other base stations become necessary. FIG. 3B illustrates what happens when the wireless device either is out of range from the target base station 70, or when another base station becomes more efficient to use. In the example of FIG. 3B, base station 72 becomes the target base station while base station 70 becomes a non-target base station. Upon acquisition of the new target base station 72, the antenna 100 changes the directivity of the radiation pattern toward the new target base station 72. Briefly, this is accomplished by selectively activating one or more radiating elements incorporated onto the antenna 100, and utilizing these limited radiating elements to transmit and/or receive the voice or data signal to and from the target base station. In a similar manner, if the wireless device is rotated, or the user moves so that the same target base station is still acquired, but the previously activated radiating element no longer faces that target base station, the wireless device changes which antenna elements are activated so that continuous contact is maintained with the base station while still only utilizing a small portion of the antenna capability and continuing to conserve power.

FIG. 3C illustrates the initiation of a further base station hand off as the wireless device 50 moves out of the range of target base station 72 and into the range of target base station 74. Again, the direction that the signal from the wireless device 50 is transmitted is adjusted so that it is directed toward the new target base station 74. In this manner, once the target base station 74 has been acquired, the other non-target base stations that are within the range of the wireless device, experience a minimal amount of interference from the wireless device 50.

Since it takes a larger amount of power to transmit a signal in all directions than it does to transmit a signal through a limited portion of an azimuth, wireless devices that utilize an antenna 100 in accordance with the present invention requires less power to maintain similar performance characteristics as a known omni-directional antenna. For example, if the antenna only transmits a signal from a 90° portion of its total 360° range, only 25% as much power is required to transmit the same range. Since each individual radiating element in the antenna 100 has significantly more gain than a single omni-directional radiator, the power output requirements of the transmitter are reduced accordingly. Antenna gain is achieved by narrowing the radiation pattern of each antenna element. Alternately, a wireless device utilizing an antenna 100 in accordance with the present invention can demand the same power requirements as a known omni-directional antenna while providing a larger coverage area due to the ability to focus the azimuth of the transmission.

Figure 4A:
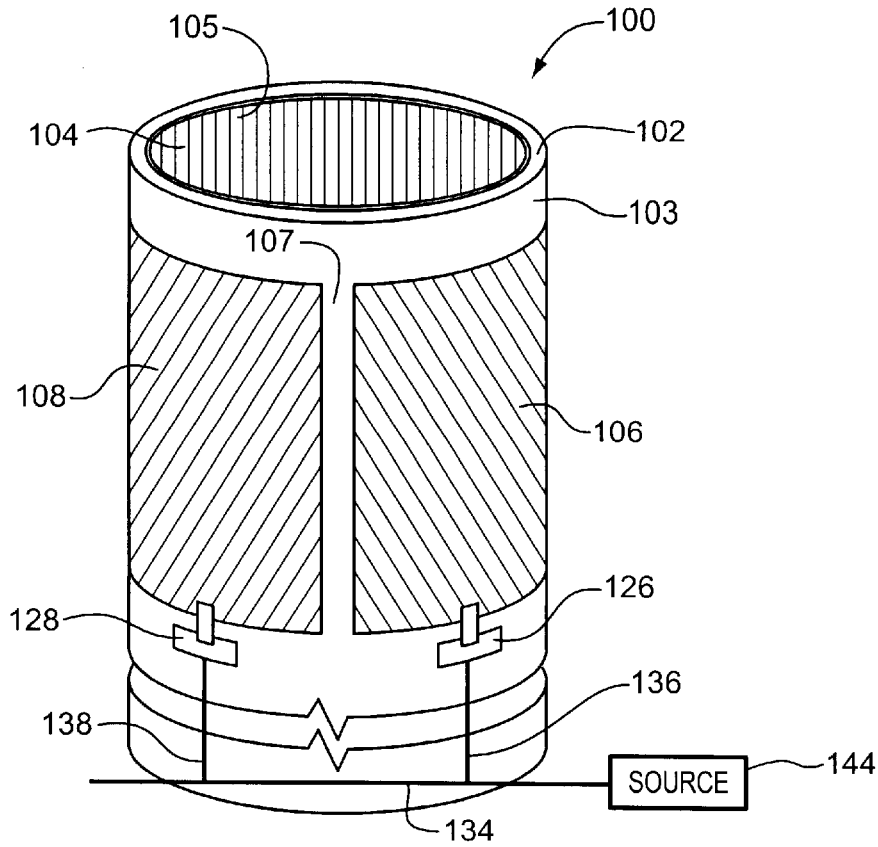
FIG. 4A shows a perspective view of an antenna in accordance with the present invention.
Figure 4B:
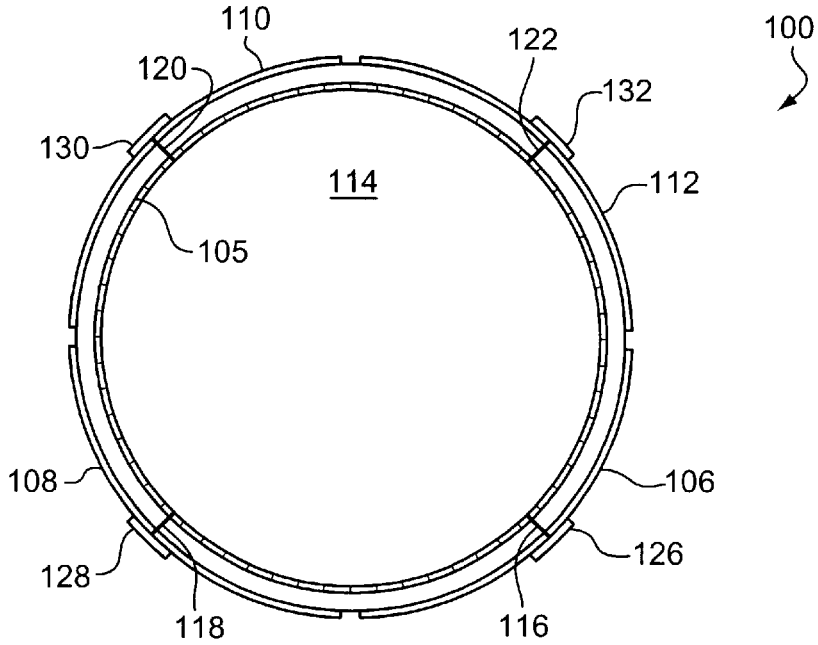
FIG. 4B shows a side cross sectional view of the antenna of FIG. 4A.

FIGS. 4A–4C show a preferred embodiment of an antenna 100 in accordance with the present invention. Preferably, the antenna 100 has a tubular body 102 with a cylindrical outer surface 103 and a cylindrical inner surface 105. Preferably, the tubular body has a diameter of approximately 50 mm. The body 102 is formed from a dielectric material such as Lexan type 104. Other materials that are conducive to the construction of patch-type antennas and that are suitable for inexpensive manufacturing processes such as injection molding may also be used to construct the body 102. The cylindrical interior surface 105 includes on its surface a substantially uniform metalized layer 104. The antenna 100 is preferably constructed in accordance with the structure of a patch antenna. In that sense, metalized layer 104 forms the ground plane component of the antenna 100. The exterior surface 103 includes a series of radiating elements (patches) that conform to the cylindrical shape of the exterior surface 103.

Preferably, each patch element has a physical dimension of:

$$\lambda_g/2 \times \lambda_g/2$$

where $\lambda_g$ is the wavelength of the dielectric material. Thus for an antenna that has n radiating elements, the circumference is approximately:

$$n/2 * \lambda_g$$

and the height is at least $\lambda_g/2$

In the embodiment shown in FIGS. 4A–4C, a series of four radiating elements 106, 108, 110, and 112 are shown, each of the radiating elements covering approximately 25% of the circumference of the exterior surface 103. The length of each of the radiating elements can vary and will depend on the type of antenna application. There is preferably a space 107 between adjacent radiating elements so that they will operate independently from each other. The size of the space 107 is sufficient so as to reduce any capacitive or parasitic effects between the adjacent radiating elements. Since the radiating elements do not touch, they each cover slightly less than 90° of the circumference of the exterior surface 103. The use of more or less than four radiating elements is contemplated by the present invention and will largely depend on the specific design requirements and cost considerations. Generally, the more radiating elements that are utilized, the more focused a transmission signal can be and the more efficiently a wireless device can operate. The pattern of a radiating element is fixed and more radiating elements permit finer granularity along the azimuth and a more constant gain.

Together, the tubular body 102, the ground plane material 104 and the radiating elements 106, 108, 110, and 112, form the three main components of a patch antenna system. Feed pins 116, 118, 120, and 122 respectively connect each of the radiating elements 106, 108, 110, and 112 to the ground plane material 104. Feed lines 136, 138, 140 and 142 connect a transmission line 134 to switching devices 126, 128, 130, and 132. The transmission line 134 provides a path for power and RF signals generated at a source location 144, to reach each of the antenna elements. Further details on the construction of patch antenna systems are disclosed in U.S. patent application Ser. Nos. 09/316,457, and 09/316,459, the details of which are hereby incorporated into this application by reference.

Referring to FIG. 4C, the transmission line 134 distributes the power and data signal through a feed line 136, 138, 140, and 142, to each of the feed pins 116, 118, 120, and 122. The transmission line 134 is connected to the operating electronics that are associated with a particular wireless device, for example, the transceiver circuitry associated with a cell phone, pager, or wireless modem. Switching devices 126, 128, 130, and 132 operate to selectively direct the data signal and power from each of the feed lines 136, 138, 140, and 142 to the respective radiating element, thereby activating a select one of the radiating elements 106, 108, 110, or 112. Alternately, the switching devices can selectively direct the power and data signal to a select group of feed lines, thereby activating a select group of radiating elements rather than only a single radiating element. Inherent in this structure is a built in logic function, preferably in the wireless device programming, that is capable of selecting which radiating element to activate depending on the relative signal strength of a base station that is being acquired. This can take the form of a simple search function that initially seeks out a base station with an acceptable signal strength, and acquires that base station. That particular target base station is then maintained in communication with the wireless device by relying only on a narrowed antenna transmission signal. Additional logic circuitry and programming within the wireless device will rotate which antenna elements are utilized depending on the position and orientation of the wireless device in relation to the target base station. If the signal between the target base station and the wireless device drops below a certain threshold level, then the wireless device searches for a more appropriate target base station. During this procedure, more than one, more preferably, all of the antenna elements are utilized in order to find a target base station with the best acquisition parameters.

FIG. 4D illustrates a plan view of radiation patterns 106-A, 108-A, 110-A, and 112-A that are associated with each of the radiating elements 106, 108, 110, and 112. Each radiating element in FIG. 4D generates a radiation pattern that covers approximately 25% of the total circumference of the exterior surface of the antenna 100. For example, the radiation pattern 106-A substantially covers the 0–90° range of the antenna 100, the radiation pattern 108-A substantially covers the 90°–180° range of the antenna 100, the radiation pattern 110-A substantially covers the 180°–270° range of the antenna 100, and the radiation pattern 112-A substantially covers the 270°–360° range of the antenna 100. The angular references are relative to FIG. 4C and it is understood that these ranges will depend on the particular system employed and the arrangement of the radiating elements on the particular antenna. Additionally, since the antenna will in most situations constantly moving, the relative angular coverage will similarly change.

Figure 5:
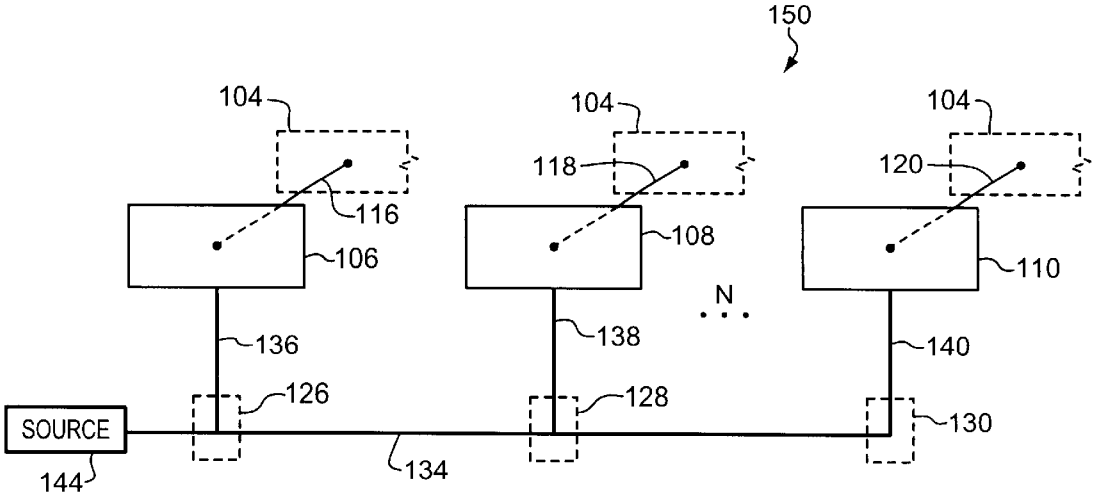
FIG. 5 shows a first preferred embodiment of a feed network utilized in an antenna in accordance with the present invention.

FIG. 5 shows a preferred embodiment of a feed network 150 that is utilized in an antenna 100 in accordance with the present invention. The feed network 150 is used to selectively activate a single radiating element on the antenna 100. Alternately, the feed network 150 is used to activate a selected group (i.e. one or more) of radiating elements on the antenna. An appropriate programming scheme incorporated into the wireless device determines the precise control over which radiating elements are activated at any given time. A source 144 feeds power and an RF signal through the transmission line 134. The source 144 power and data signals come from the operative electronics of the particular wireless device being used, for example the transceiver circuitry of a cellular phone, pager or wireless modem. Branching off of the transmission line 134 are each of the feed lines 136, 138, and 140. The configuration shown in FIG. 5 can be used with an antenna that utilizes any number of radiating elements up to N radiating elements. The feed network 150 can be extended or reduced to accommodate a greater or fewer number of radiating elements. In a preferred embodiment, between three and six radiating elements are utilized. A switching device is located at the point where each of the feed lines connects to the transmission line 134. FIG. 5 shows switching devices 126, 128, and 130 corresponding respectively to each of the feed lines 136, 138, and 140, and each of the radiating elements 106, 108, and 110. Each switching device preferably functions independently of the others, and independently controls whether the RF signal from the transmission line 134 is directed through the corresponding feed line 136, 138, or 140, and onto the corresponding radiating element 106, 108, or 110. Direct current through the switching device allows the RF signal to flow through, while a reverse bias prevents the RF signal from flowing through. The switching devices allow a selected radiating element or a selected group of radiating elements to be connected to the transmission line 134, allowing one or more of the N radiating elements to be activated and thereby selected for transmission/reception. The transmission line 134 can be an independently insulted copper conductor, or it can alternately be a printed conductor located on the exterior surface 103 of the antenna body 102. Also shown in FIG. 5 are grounding leads 116, 118, and 120 that respectively connect each of the radiating elements 106, 108, and 110 to the ground plane 104. The grounding leads function as the return path for the switching device and prevents a static electricity charge from building up on the patch and potentially damaging the electronics.

Figure 6:
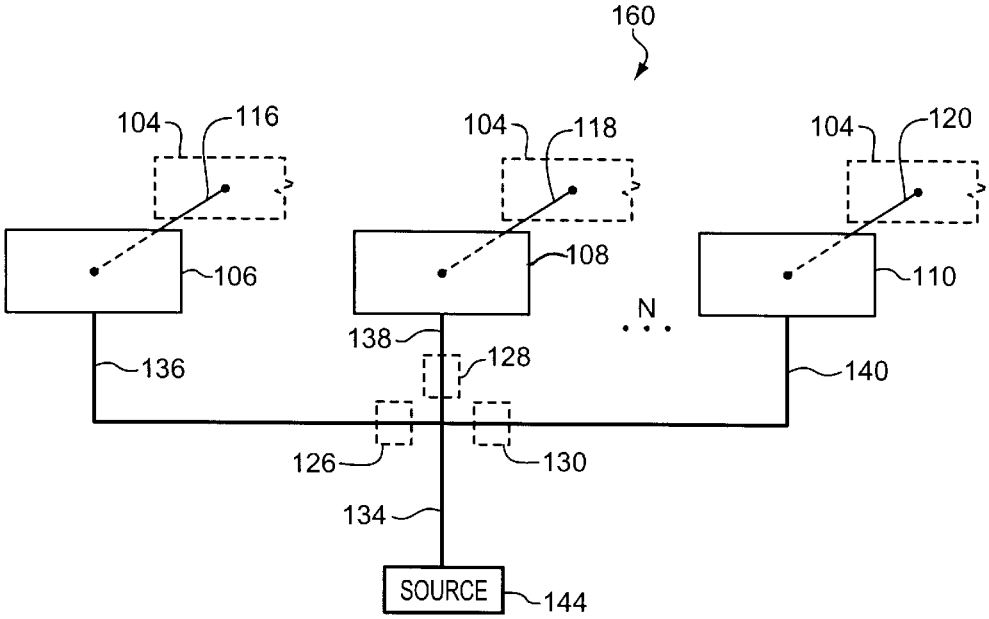
FIG. 6 shows a second preferred embodiment of a feed network utilized in an antenna in accordance with the present invention.

FIG. 6 shows an alternate embodiment of a feed network 160 that is utilized in an antenna in accordance with the present invention, to selectively feed a single radiating element, or to feed a selected group of radiating elements on the antenna. In contrast to the feed network 150, the feed network 160 has each of the switching devices 126, 128, and 130 all grouped proximate to the transmission line 134. The feed lines 136, 138, and 140 each branch from a respective switching device and connect to a respective radiating element. Grouping the switching device together may provide design layout benefits depending on the particular device being utilized. For example, it may be beneficial to keep each of the switching devices grouped together in order to reduce the amount of wiring that needs to be run from a program control unit located within the wireless device, to the switching devices. As with the feed network 150, the feed network 160 includes grounding pins 116, 118, and 120 respectively connecting each of the radiating elements 106, 108, and 110 to the ground plane 104. Various other configurations for the feed network are contemplated by the present invention and will be apparent to those skilled in the art.

Figure 7A:
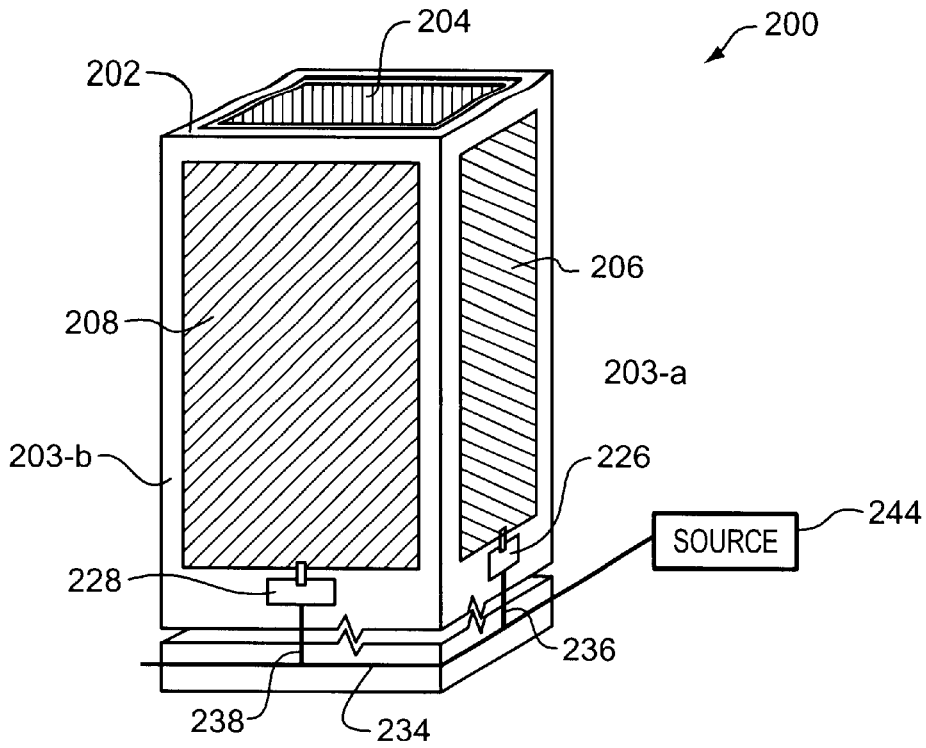
FIGS. 7A–7B show a first alternate embodiment of an antenna in accordance with the present invention.
Figure 7B:
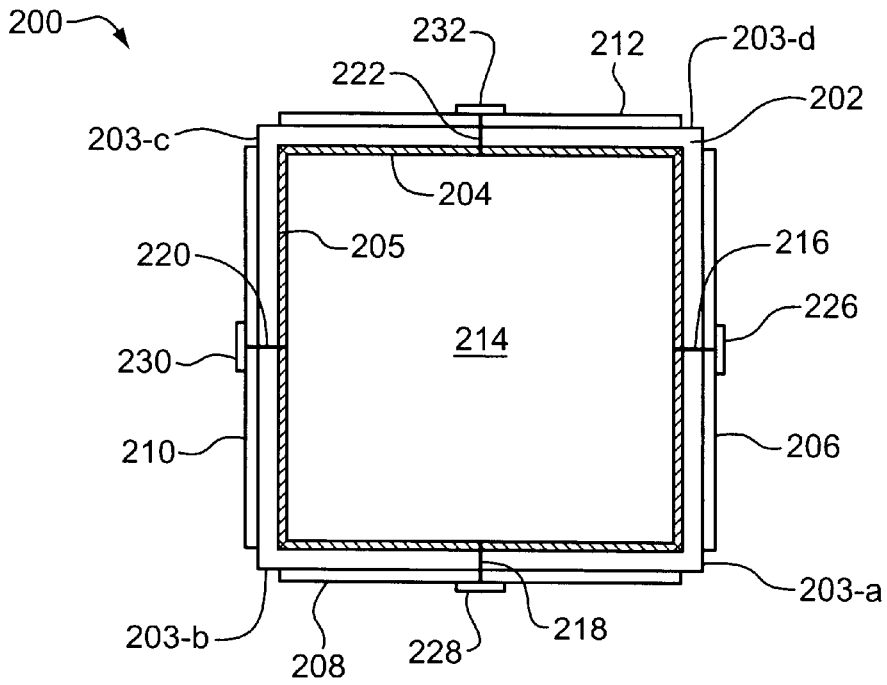

FIGS. 7A and 7B show a first alternate embodiment of an antenna 200 in accordance with the present invention. The antenna 200 is constructed in substantially the same manner as the antenna 100 shown and described in conjunction with FIGS. 4A–4C. Notably, the antenna 200 has a rectangularly shaped dielectric body 202 rather than the cylindrically shaped dielectric body 102 of the antenna 100. In FIGS. 7A and 7B, each of the four exterior surfaces 203-*a*, 203-*b*, 203-*c*, and 203-*d*, of the antenna body 202 includes a single radiating element 206, 208, 210, and 212 respectively. An interior surface 205 of the antenna body 202 includes a metalized ground plane coating 204, and a feed pin 216, 218, 220, and 222 respectively connects each of the radiating elements to the ground plane 204. A transmission line 234 distributes power and signals, generated by a source 244. Feed lines 236, 238, 240, and 242, pass the power and data signal from the transmission line 234 through a respective switching device 226, 228, 230, and 232. A particular radiating element or a particular group of radiating elements is activated by selectively enabling one or more of the switching devices 226, 228, 230, and 232. Depending on the radiating elements that are selected, by switching on one or more of the switching devices, the power and data signal is passed from the transmission line 234, through a corresponding feed line and power and a data signal is provided to the respective radiating elements.

Figure 8A:
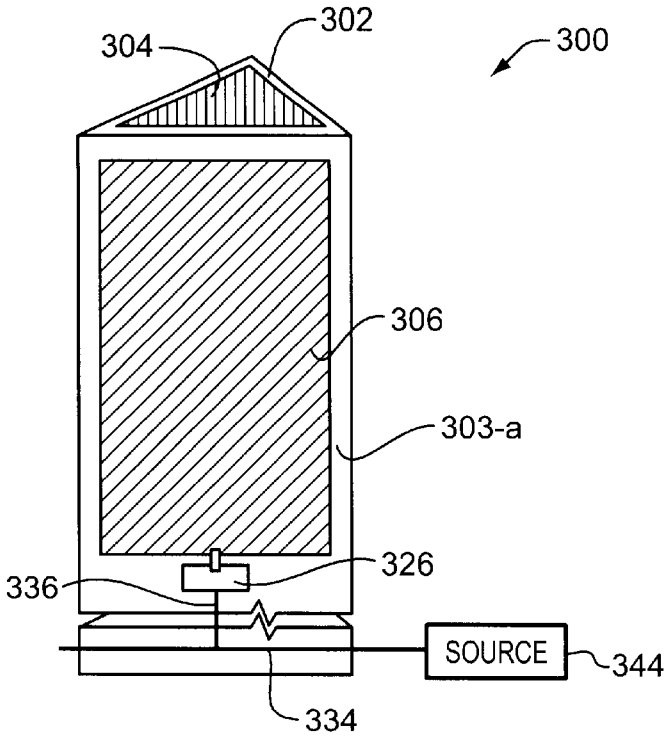
FIGS. 8A–8B show a second alternate embodiment of an antenna in accordance with the present invention.
Figure 8B:
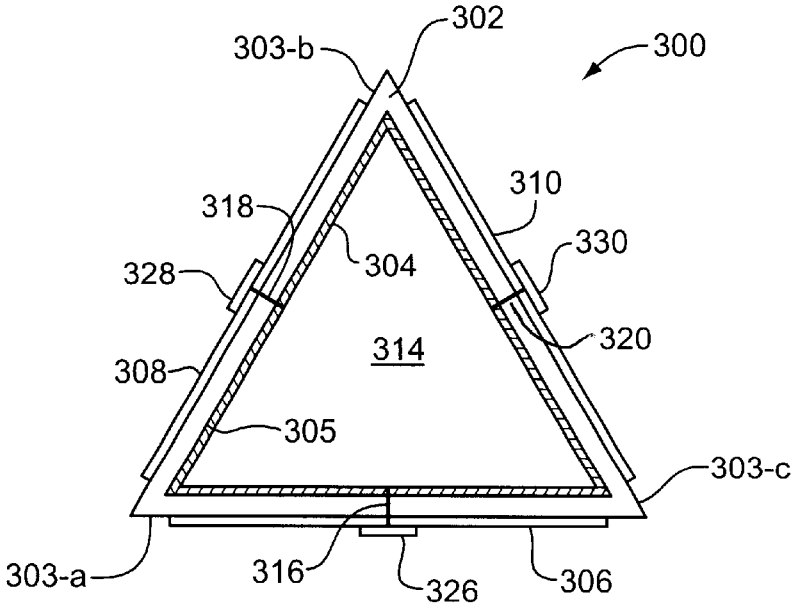

FIGS. 8A and 8B show another alternate embodiment of an antenna 300 in accordance with the present invention. The antenna 300 is constructed in substantially the same manner as the antenna 100 shown and described in conjunction with FIGS. 4A–4C. Notably, the antenna 300 has a triangularly shaped dielectric body 302 rather than the cylindrically shaped dielectric body 102 of the antenna 100. In FIGS. 8A and 8B, each of the three exterior surfaces 303-*a*, 303-*b*, and 303-*c*, of the antenna body 302 includes a single radiating element 306, 308, and 310 respectively. An interior surface 305 of the antenna body 302 includes a metalized ground plane coating 304, and a feed pin 316, 318, and 320 respectively connects each of the radiating elements to the ground plane 304. A transmission line 334 distributes power and signals, generated by a source 344. Feed lines 336, 338, and 340 pass the power and data signal from the transmission line 334 through a respective switching device 326, 328, and 330. A particular radiating element or a particular group of radiating elements is activated by selectively enabling one or more of the switching devices 326, 328, and 330. Depending on the radiating elements that are selected, by switching on one or more of the switching devices, the power and data signal is passed from the transmission line 334, through a corresponding feed line and power and a data signal is provided to the respective radiating elements.

While the alternate embodiments shown in FIGS. 7A–7B and 8A–8B depict two alternate geometries for an antenna in accordance with the present invention, various other configurations will be apparent to one skilled in the art, for example, hexagonal and octagonal shaped antenna bodies are also contemplated by an antenna in accordance with the present invention. Additionally, radiating elements can be located in any plane, for instance, on the top surface of the antenna to radiate vertically (e.g., toward a satellite).

Figure 9:
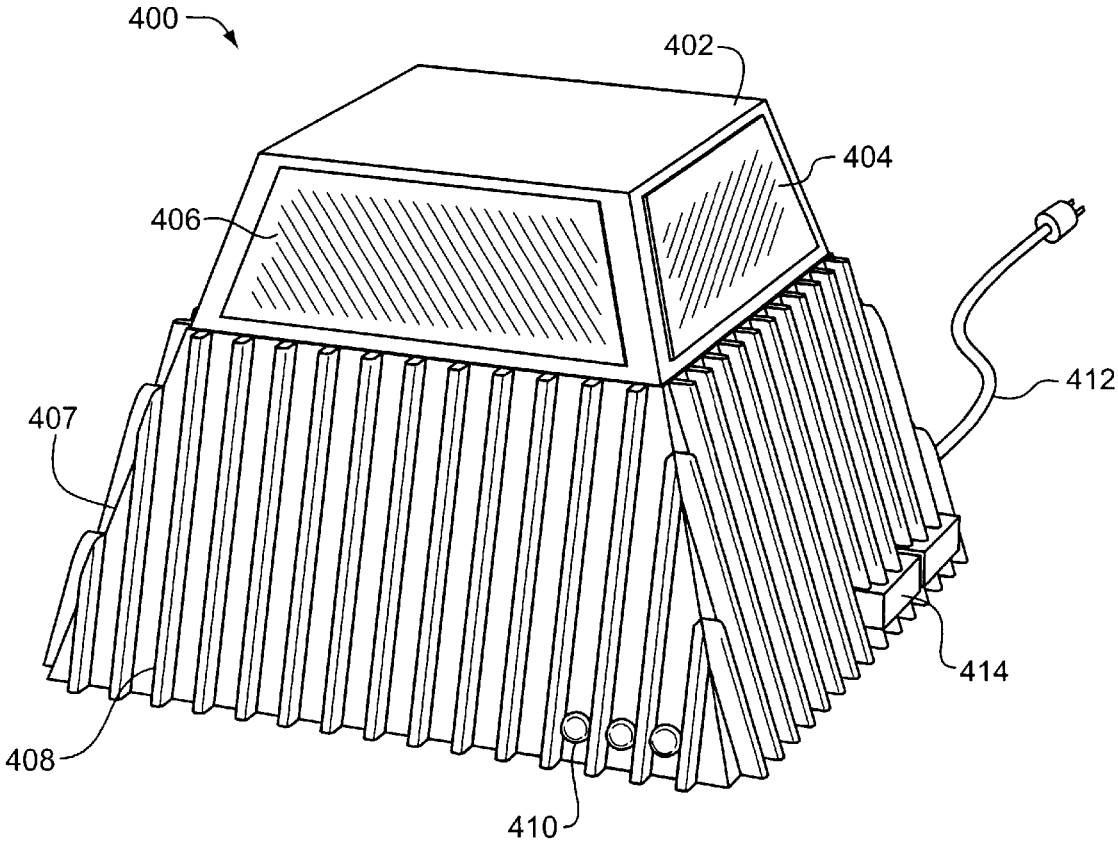
FIG. 9 shows a radio module utilizing an antenna in accordance with the present invention.

An antenna constructed in accordance with the present invention can also be used in conjunction with a radio module that is fixed in place and utilized in a wireless local loop (WLL) network. Such radio modules are often permanently mounted on a building, wall, or mast and allow users within a local network to communicate via a wireless loop rather than relying on a completely hard wired system. FIG. 9 shows such a radio module 400 that incorporates an antenna in accordance with the present invention. The radio module 400 includes a dielectric body 402 that includes a radiating antenna element on each of its side surfaces. In the preferred embodiment of FIG. 9, the radio module 400 has four sides and a radiating element is located on each of the four sides. Radiating elements 404 and 406 are visible in FIG. 9. Since the radio module 400 is typically a fixed installation, the body 402 is preferably tapered in order to give the radio module 400 more stability on its mounting location and to direct each of the antenna elements in a slightly upward direction. Multiple patch systems can also be incorporated onto a single antenna structure in order to provide diversity in the operation of the system.

The radio module 400 also includes indicator lights 410, data ports 414 and a power cable 412. A lower portion 407 of the radio module 400 has a textured or ribbed surface 408 to increase the effective surface area of the enclosure and to increase the heat dissipation of the system. U.S. Patent Application Nos. 09/398,724 and 09/400,623 disclose further details of a preferred embodiment of such a radio module, the details of which are hereby incorporated by reference into the present application.

Figure 10A:
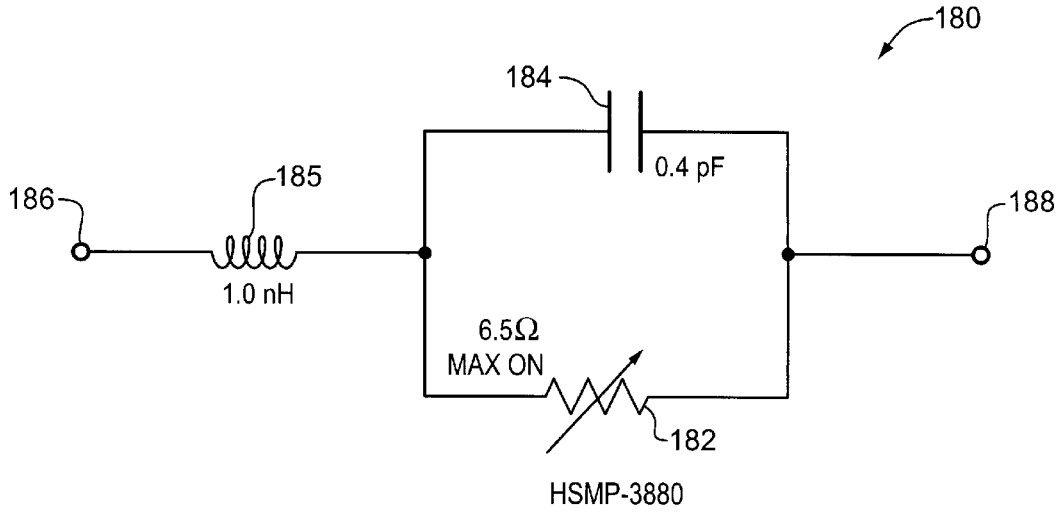
FIGS. 10A–10B show examples of switching devices that are preferably used with an antenna in accordance with the present invention.
Figure 10B:
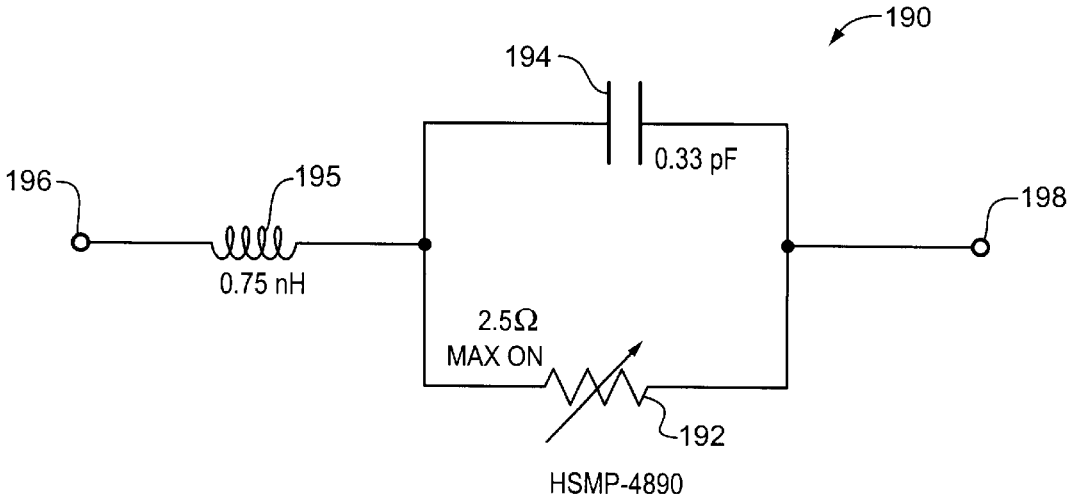

Referring briefly to FIGS. 5 and 6, each of the feed networks 150 and 160 preferably utilize a PIN diode switch, or another type of known radio frequency switch for the switching devices. Components of this type are well known in the art of antenna design. Preferred examples include switching devices manufactured by Hewlett Packard bearing Model Nos. HSMP-3880, and HSMP-4890. FIGS. 10A and 10B show the circuit diagrams for two of these switching devices. A PIN diode operates like a variable resistor for RF signals. It behaves like a diode at low frequencies. Potentiometer 182 represents the equivalent resistance of the PIN diode at RF frequencies. The value of the potentiometer 182 depends on the DC current flowing through the diode. High current equate to a low resistance and low/zero current equates to a high resistance. The impedance is also limited by the reverse capacitance of the capacitor 184.

In the example of FIG. 10A, at an "on" resistance of approximately 6.5 Ω for a large PIN bias current, the switching device 180 is on, and RF will flow from the terminal 186 to the terminal 188. With no current, the resistance at potentiometer 182 is high and the RF is reduced. An antenna radiating element therefore does not receive an RF signal when the switching device is turned off and will when the switching device is turned on. In the example of FIG. 10B, the "on" resistance is at a lower level, i.e. 2.5 Ω, due to a different PIN diode design.

The use of a PIN diode switch or a similar known RF switch for the switching device 180 is preferred due to their wide availability, low cost, and large selection. However, when utilizing a switching device such as the PIN Diode switches 180 and 190 shown in FIGS. 10A and 10B, the ability to effectively "shut off" and quickly and substantially isolate a corresponding radiating element or group of radiating elements from the others, may be compromised. Since there is a reverse junction capacitance intrinsic to the reversed biased PIN Diode, some RF is shunted past the potentiometer 182. This is due in part to the inherent characteristics of a capacitor. This leakage of charge prevents the PIN diode switch from completely isolating the active radiating elements from the deactivated ones. For example, neighboring radiating elements may remain in an activated state until most of the charge is dissipated from the PIN Diode capacitor.

Figure 11:
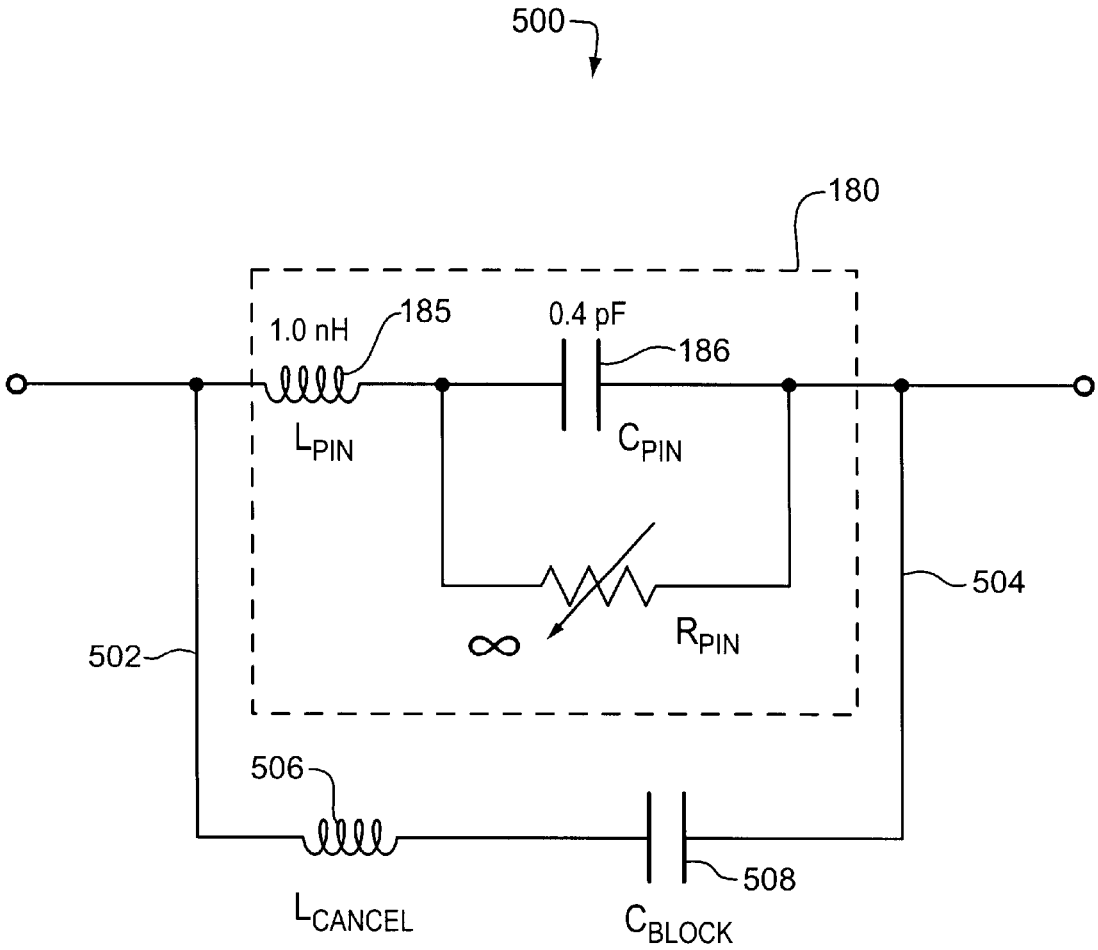
FIG. 11 is a circuit schematic of a capacitive isolation circuit incorporated into a radio frequency switching device.

FIG. 11 shows a PIN diode isolation circuit 500 in accordance with the present invention. In FIG. 11, the dashed box 181 represents the boundaries of a PIN diode switch 180, the details of which were described above in conjunction with FIG. 10A. The PIN diode switch shown in the isolation circuit 500 can be any of the known PIN diode switches. The isolation circuit 500 includes a canceling inductor 506 ($L_{CANCEL}$) joined in series with a blocking capacitor 508 ($C_{BLOCK}$). The canceling inductor 506 and the blocking capacitor 508 are jumpered around the PIN diode switch 180 through conductors 502 and 504. In this manner, any reactance charge that remains in the PIN diode switch 180 after the switching device is turned off, is resonated out through the canceling inductor 506 and the blocking capacitor 508. The size of the canceling inductor 506 ($L_{CANCEL}$) and the blocking capacitor 508 ($C_{BLOCK}$) may vary depending on the values of the PIN diode inductor 185 and PIN diode capacitor 186 within the PIN diode switch 180. In general, the value of the cancellation inductor 506 can be calculated as follows.

This example assumes that an antenna is tuned to 2.0 GHz and that $W=12.6\times10^9$ r/s.

$$Z_{PIN}=jwL_{PIN}+1/jwC_{PIN}=-j186\Omega\rightarrow Y_{PIN}=+j5.37\text{ mS}$$

Therefore, it is necessary to cancel with an inductor that provides −jB $$1/wL_{CANCEL}=5.37\text{ mS}\rightarrow L_{CANCEL}=14.8\text{ nH}$$

$$\text{Select } L_{CANCEL}=15\text{ nH}$$

Select CBLOCK to be insignificant with respect to the inductor reactance:

$$C_{BLOCK}\geqq10^*(5.37\text{ mS})/w=4.3\text{ pF}$$

$$\text{Select } C_{BLOCK}=15\text{ pF}$$

Figure 12A:
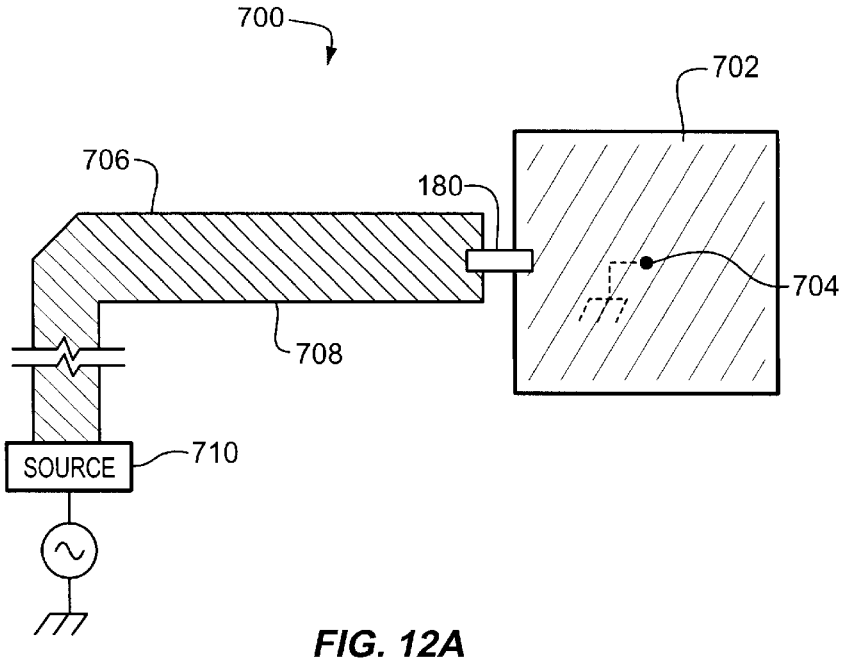
FIG. 12A is a diagram of a switching device connected to an antenna radiating element.

In many cases, it will be desired to have the antenna element at "ground" potential. This may be either to provide a current return path for the PIN diode switch or to prevent a static charge from building up on the antenna element. At the midpoint of each of the antenna elements, along its length and height, the internal field will zero out. Therefore a conductor can be placed between this mid-point on the patch and the ground plane with little or no affect on the antenna performance. FIGS. 12A shows a diagrammatic representation 700 of this type of grounding circuit and FIG.

Figure 12B:
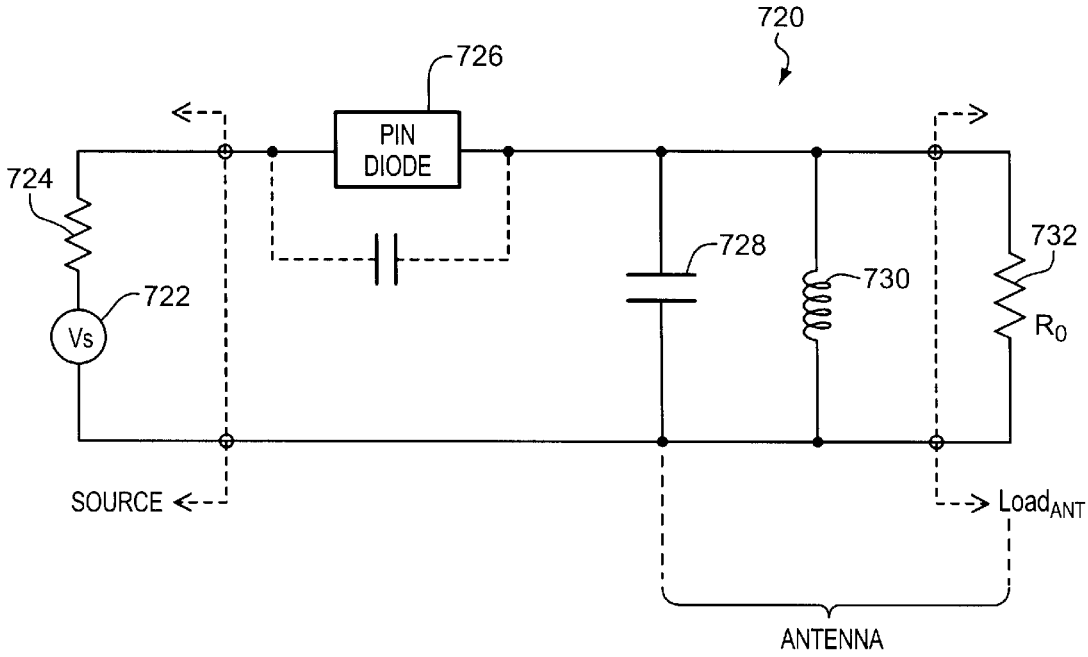
FIG. 12B is a circuit schematic including a radio frequency switching device and an electrical equivalent for the antenna element.

12B shows an equivalent electrical circuit layout 720. In FIG. 12A, the antenna element 702 includes a grounding conductor 704 that connects the antenna element 702 to the ground plane element (not shown). The feed networks shown in FIGS. 5 and 6 indicate how the grounding conductor 704 is coupled between the antenna element and the ground plane. An RF signal generated by a source system 710 is fed through a conductor 706, through the PIN diode switch 180, and onto the antenna element 702. FIG. 12B indicates the equivalent circuit 720, where a source 722 coupled with a resistor 724 feed a data signal through the PIN diode 726 and onto an antenna element. The antenna element is represented in the circuit by capacitor 728, inductor 730 and resistor 732. The resistor 732 represents the equivalent load that the antenna places on the system. The PIN diode switch 726 is shown with the isolation circuit 500 described in conjunction with FIG. 11 incorporated.

Figure 13:
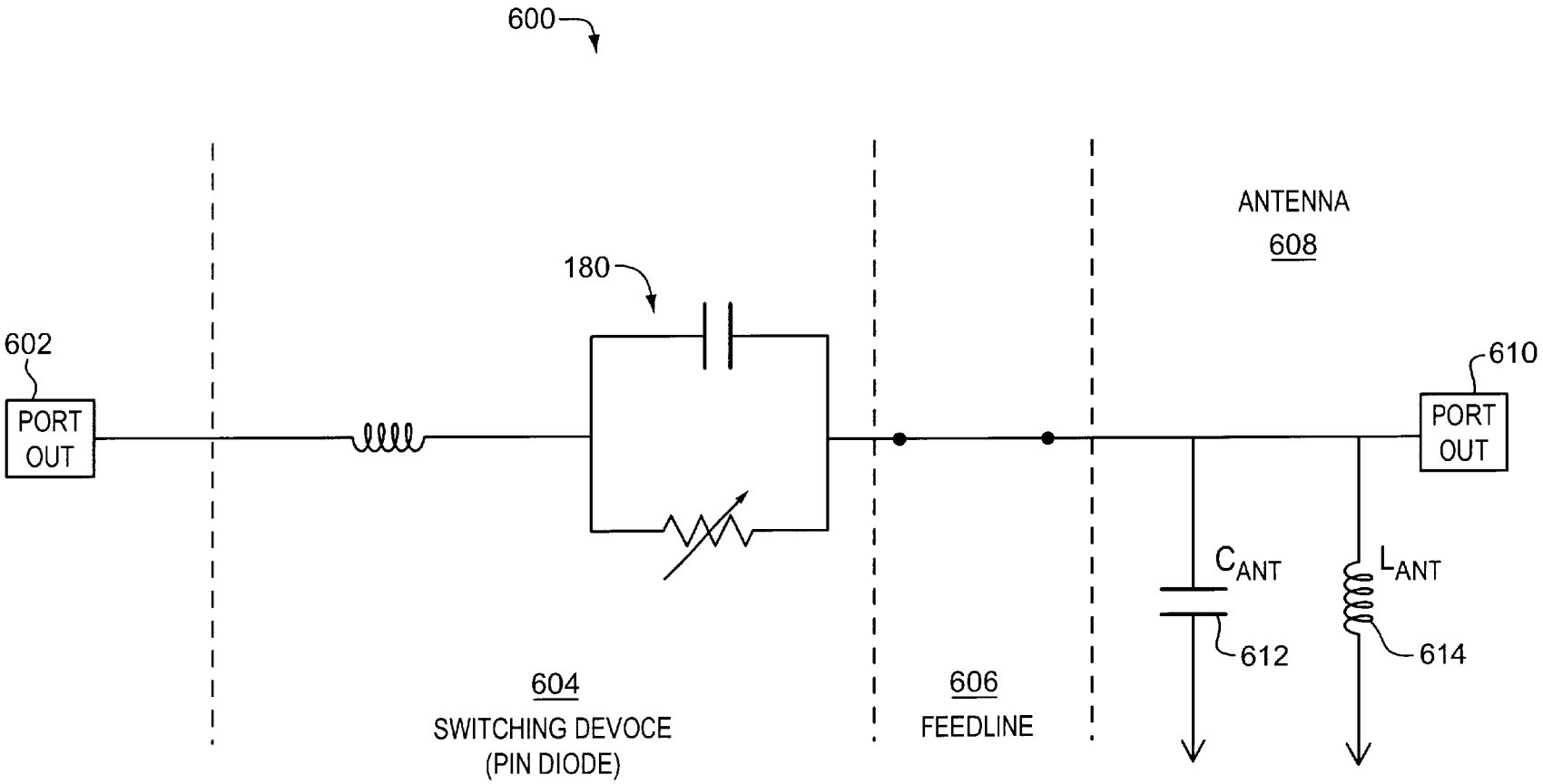
FIG. 13 is a diagrammatic representation of the circuit schematic of FIG. 12B.

FIG. 13 shows an equivalent electrical model for circuit simulation 600 resulting from the implementation of a PIN diode switch 180 into an antenna in accordance with the present invention. Port 610 is terminated and its resistance in combination with ($C_{ANT}$) 612 and ($L_{ANT}$) 614, represent the antenna element, and more specifically the transformed value of the antenna element resistance. Port 602 represents a source input, 604 represents the switching device. In this example, the switching device is the PIN diode switch 180 described previously. Reference number 606 indicates the feed line leading from the switching device 604 to the antenna 608. Reference number 608 represents the antenna element, including $C_{ANT}$ 612 and $L_{ANT}$ 614.

Figure 14:
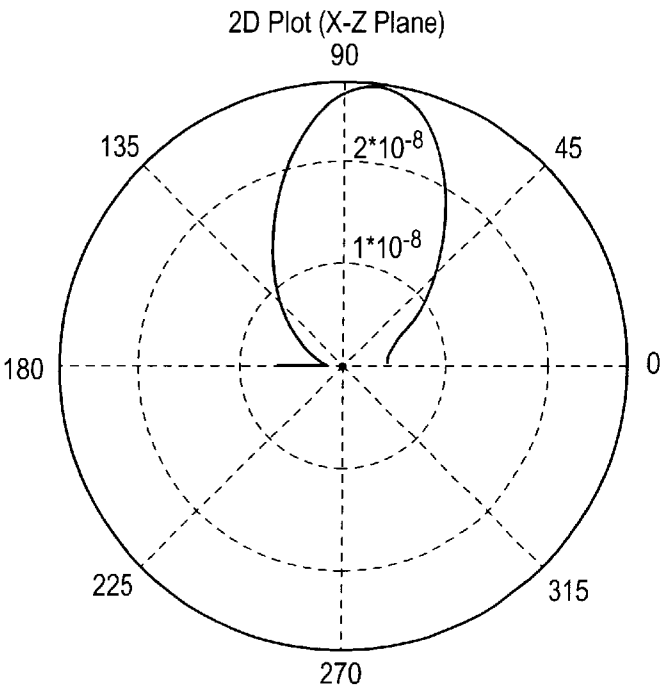
FIG. 14 is a plot of the radiation pattern of a single antenna element.
Figure 14:
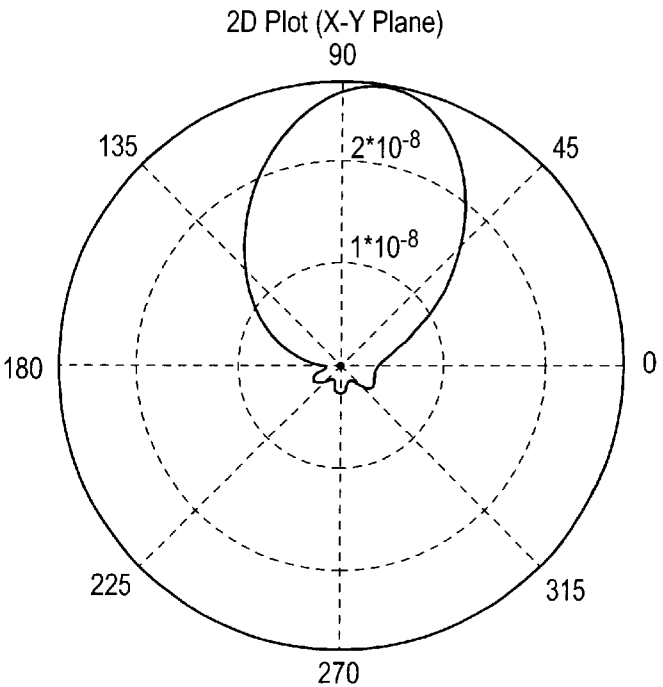

FIG. 14 shows the x-y and y-z radiation patterns associated with an antenna constructed in accordance with the present invention. In the example of FIG. 14, a cylindrical dielectric antenna body was used and three conformal antenna elements were formed on the external surface. A single antenna element was activated and the other two remained inactive. The dielectric antenna body was constructed from Lexan type 104 material. In addition, the antenna elements were tuned for 26 dB RL at 1995 MHz. The total radiated power of this antenna was $2.06\times104^{-4}$ Watts, the antenna efficiency was 85% and the directivity was 6.2 dBi. FIG. 14 shows the selected directivity of the radiation pattern generated by the single activated antenna element.

Figure 15A:
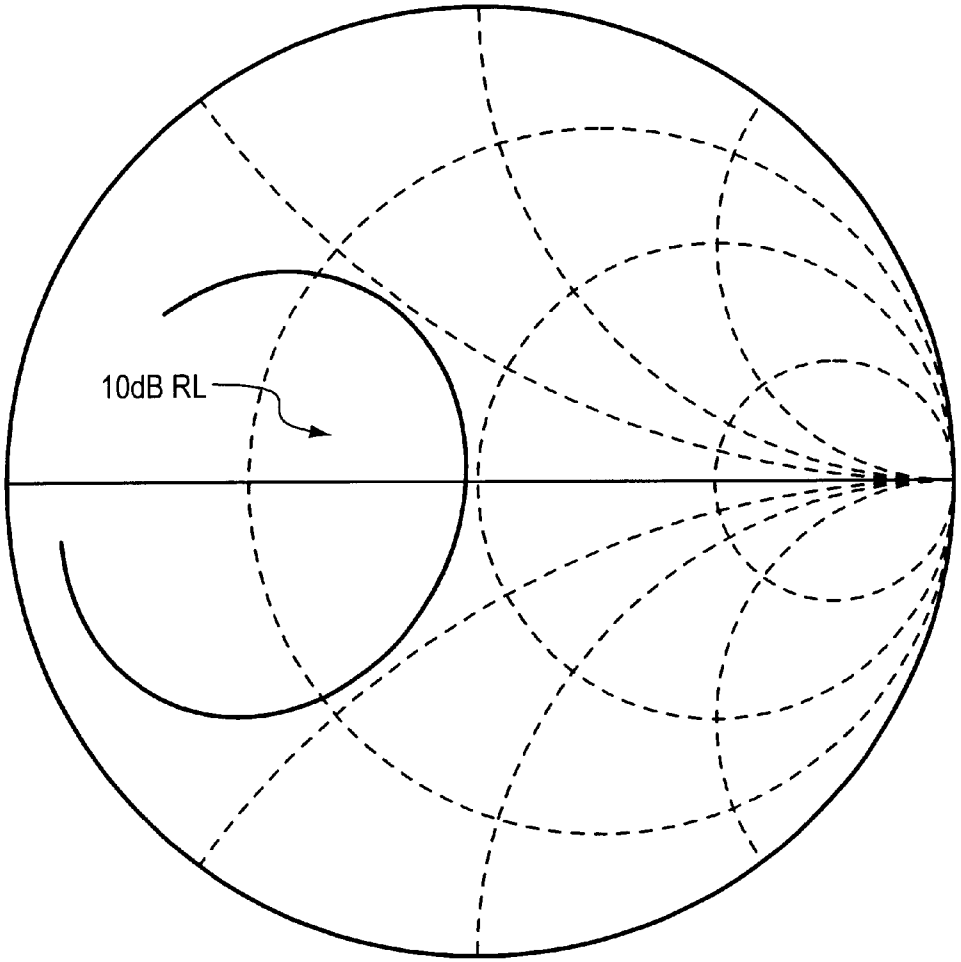
FIG. 15A is a Smith chart showing the impedance of the antenna element of FIG. 14.
Figure 15B:
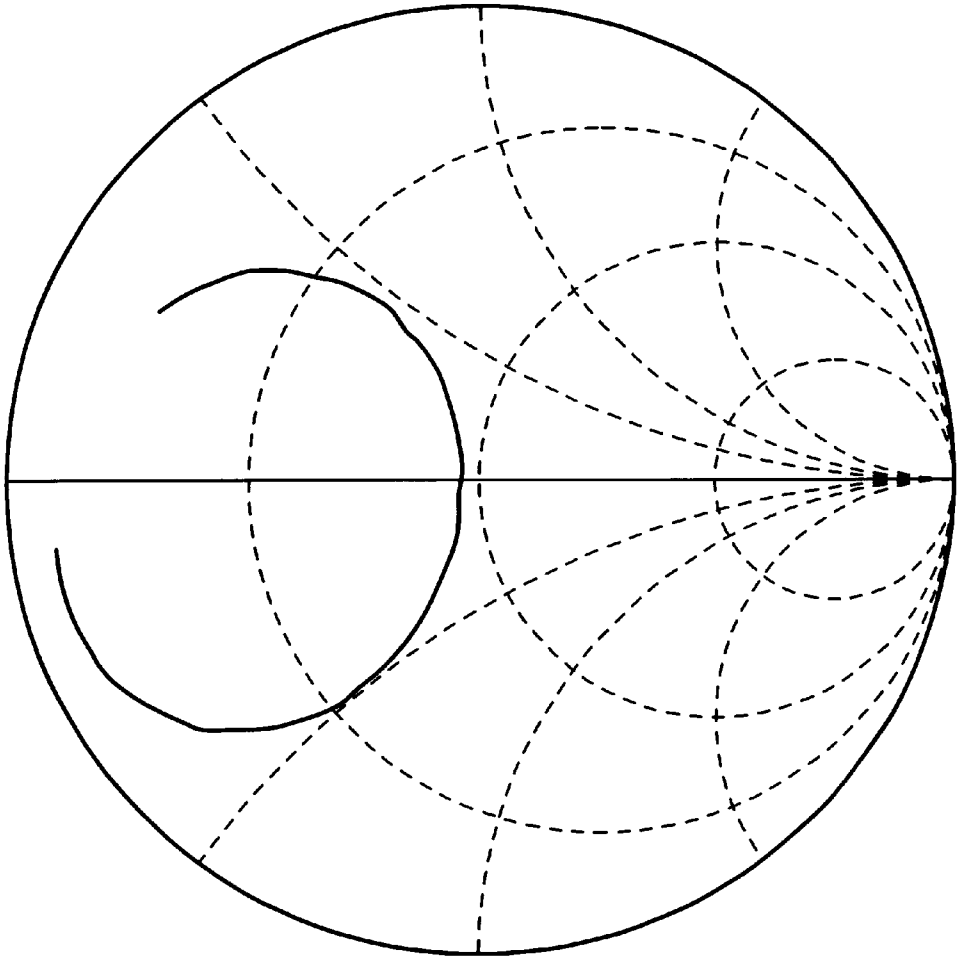
FIG. 15B is a Smith chart showing the impedance of the antenna element of FIG. 14 with a grounding pin added.

FIGS. 15A and 15B show a pair of Smith charts. The chart of FIG. 15A represents the antenna described in conjunction with FIG. 14. FIG. 15B represents the same antenna with a grounding connector between the center of the antenna element and the ground plane. This arrangement was described previously in conjunction with FIGS. 12A and 12B. As can be seen from a comparison of the two Smith charts, there is a negligible effect on the antenna performance associated with the addition of the grounding conductor 704.

Although the invention has been described and illustrated in the above description and drawings, it is understood that this description is by example only and that numerous changes and modifications can be made by those skilled in the art without departing from the true spirit and scope of the invention. The invention, therefore, is not to be restricted, except by the following claims and their equivalents.

What is claimed is:

1. An apparatus comprising:

a monopole antenna coupled to a portable communications device;

a plurality of radiating elements mounted on said monopole antenna;

control circuitry to select a subset of said plurality of radiating elements;

switching circuitry to activate said selected radiating element subset; and a plurality of feeds coupled to the switching circuitry, wherein each of said radiating elements is coupled to one of said feeds.

2. The apparatus of claim 1, wherein said control circuitry is configured to acquire a base station from a plurality of base stations based on a relative signal strength of said base station.

3. The apparatus of claim 2, wherein said control circuitry is configured to select another subset of said plurality of radiating elements as said relative orientation between said base station and said apparatus changes.

4. The apparatus of claim 2, wherein said control circuitry is configured to select said subset to direct a radiation pattern towards said base station.

5. The apparatus of claim 1, wherein said plurality of radiating elements is arranged on said monopole antenna, such that a first radiation pattern having a total angular range relative to a plane is generated when all of said plurality of radiating elements are activated, and a second radiation pattern having a decreased angular range relative to said plane is generated when said subset of radiating elements is activated.

6. The apparatus of claim 5, wherein said plane is an azimuthal plane having a center defined by a longitudinal axis of said monopole antenna.

7. The apparatus of claim 5, wherein said total angular range is 360°.

8. The apparatus of claim 5, wherein a partial radiation pattern generated when each of said plurality of radiating elements is activated overlaps partial radiation patterns generated when adjacent radiating elements are activated.

9. The apparatus of claim 1, wherein said switching circuitry comprises a PIN diode switch.

10. The apparatus of claim 1, wherein said switching circuitry comprises a relay.

11. The apparatus of claim 1, wherein said selected radiating element subset comprises a single radiating element.

12. The apparatus of claim 1, wherein said selected radiating element subset comprises two or more radiating elements.

13. The apparatus of claim 1, wherein said monopole antenna comprises a dielectric body, and said plurality of radiating elements is formed on said dielectric body.

14. The apparatus of claim 1, wherein said dielectric body has an interior and an exterior surface, said antenna further comprising a ground plane on said interior surface of said dielectric body.

15. The apparatus of claim 1, further comprising a transmission line, wherein said switching circuitry is configured to couple said transmission line to said activated radiating elements.

16. An antenna, comprising:

a monopole antenna coupled to a portable communications device;

a plurality of radiating elements mounted around said rigid structure in a 360° configuration;

control circuitry configured to select a subset of said plurality of radiating elements;

switching circuitry to activate said selected subset of radiating elements; and a plurality of feeds coupled to the switching circuitry, wherein each of said radiating elements is coupled to one of said feeds.

17. The antenna of claim 16, wherein the rigid structure has an external surface on which said plurality of radiating elements is mounted.

18. The antenna of claim 16, wherein said control circuitry is configured to acquire a base station from a plurality of base stations based on a relative signal strength of said base station.

19. The antenna of claim 16, wherein said control circuitry is configured to dynamically select said radiating element subset.

20. The antenna of claim 16, wherein said rigid structure has a circular cross-section, and said plurality of radiating elements are circumferentially mounted about said rigid structure.

21. The antenna of claim 16, wherein said rigid structure has a rectangular cross-section, and said plurality of radiating elements are mounted on four faces of said rigid structure.

22. The antenna of claim 16, wherein said rigid structure has a triangular cross-section, and said plurality of radiating elements are mounted on three faces of said rigid structure.

23. The antenna of claim 16, wherein said selected radiating element subset comprises a single radiating element.

24. The antenna of claim 16, wherein said selected radiating element subset comprises two or more radiating elements.

25. The antenna of claim 16, wherein said rigid structure comprises a dielectric body, and said plurality of radiating elements is formed on said dielectric body.

26. A method comprising:

acquiring a base station;

selecting a subset of a plurality of radiating elements by activating one or more feeds, wherein each of the radiating elements is coupled to one of said feeds; and transmitting a signal from said selected radiating element subset to said acquired first base station.

27. The method of claim 26, wherein said base station is acquired based on a signal strength of said base station.

28. The method of claim 26, wherein said selected radiating element subset comprises a single radiating element.

29. The method of claim 26, wherein said signal is transmitted using radio frequency energy.

30. The method of claim 26, wherein said radiating element subset faces said base station.

31. The method of claim 26, further comprising:

acquiring another base station;

selecting another subset of said plurality of radiating elements; and transmitting a signal from said another selected radiating element subset to said acquired second base station.

32. The method of claim 31, wherein said wireless device is handed-off from said base station to said another second base station.

33. The method of claim 26, further comprising:

selecting another subset of said plurality of radiating elements when a relative orientation between said antenna and said base station changes; and transmitting a signal from said another selected radiating element subset to said another base station.

34. An antenna comprising:

a rigid structure;

a plurality of radiating elements mounted to said rigid structure, each radiating element coupled to one of a plurality of feeds;

means for selecting a subset of said plurality of radiating elements; and means for transmitting a signal from said selected radiating element subset to a first base station.

35. The antenna of claim 34, further comprising means for acquiring said base station based on a signal strength of said base station.

36. The antenna of claim 34, wherein said selected radiating element subset comprises a single radiating element.

37. The antenna of claim 34, wherein said signal is transmitted using radio frequency energy.

38. The antenna of claim 34, wherein said radiating element subset faces said base station.

39. The antenna of claim 34, wherein said subset selection means is dynamic.

* * * * *